United States Patent [19]

Shaffner

[11] Patent Number: 4,635,821

[45] Date of Patent: Jan. 13, 1987

[54] STANDING TOOTHPASTE DISPENSER

[76] Inventor: Richard F. Shaffner, 1115 Jefferson Dr., Charlotte, N.C. 28226

[21] Appl. No.: 742,351

[22] Filed: Jun. 7, 1985

[51] Int. Cl.[4] ..... B65D 83/00; B67D 5/42

[52] U.S. Cl. ..... 222/80; 222/386

[58] Field of Search ..... 222/80, 82–86, 222/83.5, 87–88, 386, 92; 83/161

[56] References Cited

U.S. PATENT DOCUMENTS

| | | | |
|---|---|---|---|
| 1,200,219 | 10/1916 | Moxon | 222/102 X |
| 1,443,910 | 1/1923 | Zearing et al. | 222/80 |
| 1,610,484 | 12/1926 | Boggero et al. | 222/386 X |
| 1,762,943 | 6/1930 | Zauder | 222/80 |
| 2,566,503 | 9/1951 | Snyder | 222/102 |
| 3,275,195 | 9/1966 | Reinstra | 222/102 |
| 3,432,078 | 3/1969 | Hall | 222/80 |
| 3,478,928 | 9/1969 | Caldwell | 222/103 |
| 3,675,821 | 7/1972 | Morane et al. | 222/80 |
| 3,870,200 | 3/1975 | Spatz | 222/386 X |
| 4,493,436 | 1/1985 | Brokaw | 222/80 |

FOREIGN PATENT DOCUMENTS

| | | | |
|---|---|---|---|
| 962978 | 2/1975 | Canada . | |
| 951165 | 10/1956 | Fed. Rep. of Germany . | |
| 747592 | 4/1933 | France | 222/386 |
| 411504 | 8/1945 | Italy | 222/386 |
| 716248 | 10/1966 | Italy . | |

*Primary Examiner*—Charles A. Marmor

*Attorney, Agent, or Firm*—Dowell & Dowell

[57] ABSTRACT

A container and dispensing apparatus for discharging selected amounts of a paste, cream or other viscous material or products such as toothpastes which includes a generally cylindrical container having a dispensing nozzle at one end and a generally circular base portion at the other end thereof. The base portion of the container is received within a dispenser and collector assembly which includes a plurality of cutter blades which surround a central fixed piston whereby, as the container is urged downwardly against the cutting blades the container is cut into a plurality of separate strips which are received and stored within the dispenser while the product in the container is urged outwardly of the dispensing nozzle by the fixed piston.

16 Claims, 5 Drawing Figures

STANDING TOOTHPASTE DISPENSER

BACKGROUND OF THE INVENTION

1. FIELD OF THE INVENTION

This invention is generally related to compressible product dispensers and particularly to a container and a dispenser for supporting and storing the container as the material contained therein is being discharged. The dispenser includes a fixed central piston mechanism which urges the product from the container and cutter means for slicing the container into strips which are readily rolled and stored within the dispenser apparatus.

2. HISTORY OF THE PRIOR ART

The dispensing of products from disposable containers is an everyday occurrence for almost every individual in this country. Most frequently, dispensable collapsible containers or tubes are used to dispense hygienic products such as toothpaste, soaps, shampoos, hair creams, lotions and the like. Considering the amount of pastes, creams and other similar viscous liquid products that are dispensed in collapsible containers or tubes, there has been little effective innovations directed toward both making the use of such containers more neat and clean while providing dispensing means which are esthetic and which provide for maximum economic savings by insuring that substantially all the product stored in such containers is dispensed for use prior to discarding the container or prior to the time the dispenser becomes inoperable.

Almost everyone is familiar with the general use of a collapsible wall container-dispenser. Due to indiscriminate squeezing of such containers either much of the product contained therein is not dispensed or the walls or seams securing the walls fracture releasing the contents in a messy and uncontrollable manner. A typical or conventional collapsible container is a tube having plastic side walls which are joined at a seam defining the base of the tube. The outlet is generally formed of a less pliable nozzle portion which may have a screw type cap removably secured thereto. Even if care is taken to neatly and systematically dispense the product from such containers, there generally remains a portion of the product which simply is not or cannot be squeezed or discharged therefrom. This is particularly true when there is no structure provided to scrape the side walls of such containers or means provided to collapse or completely engage the outlet portion thereof to ensure complete product removal.

In order to reduce the waste involved in the use of most conventional paste dispensers, numerous designs have been developed to provide mechanical assistance for discharging the products from collapsible tubes. Further, recognizing the adverse esthetics involved with using collapsible dispensers, some prior art dispensing mechanisms were additionally designed to provide a housing for the containers so that the containers or tubes were always hidden from view. One such dispenser is disclosed in U.S. Pat. No. 3,275,195 to Reinstra wherein the tube is stored in a decorative or simulative housing with the tube being connected via a secondary conduit to a point of discharge.

Other prior art developments provide mechanical dispensers which include structures for systematically forcing a product from a collapsible wall container or tube and also provide a storage area to receive the used portions of the tube as the product is dispensed. Most such devices, however, are not economical to construct and therefore would not obtain consumer approval or are cumbersome or awkward to use. In addition, many such dispensers still leave a percentage of the product in the collapsed tube after the tube has been fully acted on. Some additional examples of prior art include structures disclosed in U.S. Pat. No. 1,200,219 to Moxon; U.S. Pat. No. 2,566,503 to Snyder; U.S. Pat. No. 3,478,928 to Caldwell; Canadian Pat. No. 962,978 and Italian Pat. No. 716,248.

As an alternative to rolling used containers within a dispenser housing, several prior art dispensing devices have provided means for continuously cutting or severing portions of a container as the product contained therein is dispensed. Examples of such dispensers include U.S. Pat. No. 1,610,484 to Boggero et al; U.S. Pat. No. 1,762,943 to Zander and U.S. Pat. No. 3,432,078 to Hall. In each of these patents, a container is rotated towards the base during which rotation the base cuts the advancing portions of the container into elongated strips which are either fed outwardly of the base causing a hazzard or storage problem or are shaved off and deposited in the base.

SUMMARY OF THE INVENTION

This invention is directed to a container and dispenser for dispensing viscous products in which the container is constructed having collapsible side walls which are generally cylindrically formed and which also includes a base portion which is severably connected to the side walls. The container is selectively mounted to a dispenser having a central body member which functions as a fixed piston to urge the product from the container as the container is forced toward the dispenser and wherein the fixed piston is supported in spaced relationship to an outer base or housing by way of a plurality of wall elements or flanges which function as cutters to sever the side walls of the container into strips of generally equal width as the container is urged downwardly with respect to the fixed piston. The invention further includes a containment assembly which is mounted within the housing or base of the dispenser and which includes a plurality of cradles which cooperate with arcuately shaped portions of the lower end of the fixed piston to form generally cylindrical storage areas into which the cut strips of container are rolled and retained.

It is the primary object of this invention to provide a combination container and dispensing apparatus in which generally viscous liquid products including hygienic pastes, creams, salves, foams, as well as other viscous liquid materials, may be stored and selectively dispensed by urging the container toward a generally fixed base member which receives and stores the container as the container is continuously urged into the base.

It is another object of the present invention to provide an apparatus for dispensing viscous pastes and similar products from collapsible containers wherein substantially all of the product may be expelled from the container as the walls thereof are forced past a fixed piston member.

It is yet a further object of the present invention to provide an apparatus for dispensing tooth paste and other viscous fluid products from collapsible containers wherein the side walls of the containers generally retain their original esthetic shape as the product is urged therefrom.

It is another object of the present invention to provide a dispenser for hygienic pastes and other viscous liquids in which the product is progressively urged from a collapsible wall container and wherein the used portions of the container are severed into a plurality of strips which are continuously received and stored within the dispenser.

It is still another object of the present invention to provide a container and dispensing apparatus for dispensing products especially of the type such as toothpaste which are normally stored in an open area which presents an esthetic appearance and wherein the apparatus is continuously maintained in a neat and clean condition as product is dispensed therefrom.

It is also an object of the present invention to provide a container and dispensing apparatus wherein the base or dispensing portion thereof may be selectively used to support, retain and dispense pastes, creams and the like from collapsible containers and wherein, after all the product has been expelled from the container, the container may be removed from the dispenser and another container placed into dispensing engagement therewith.

It is yet another object of the present invention to provide a dispensing system for dispensing toothpastes and the like wherein the dispensing tube or container is retained in a vertical housing which acts to store the used portions of the container as the contents are progressively urged therefrom and in which the tube or container may be easily acted on by simply pressing downwardly on the cap thereof to dispense a selected amount of product.

DESCRIPTION OF THE PREFERRED EMBODIMENT

Figure 1:
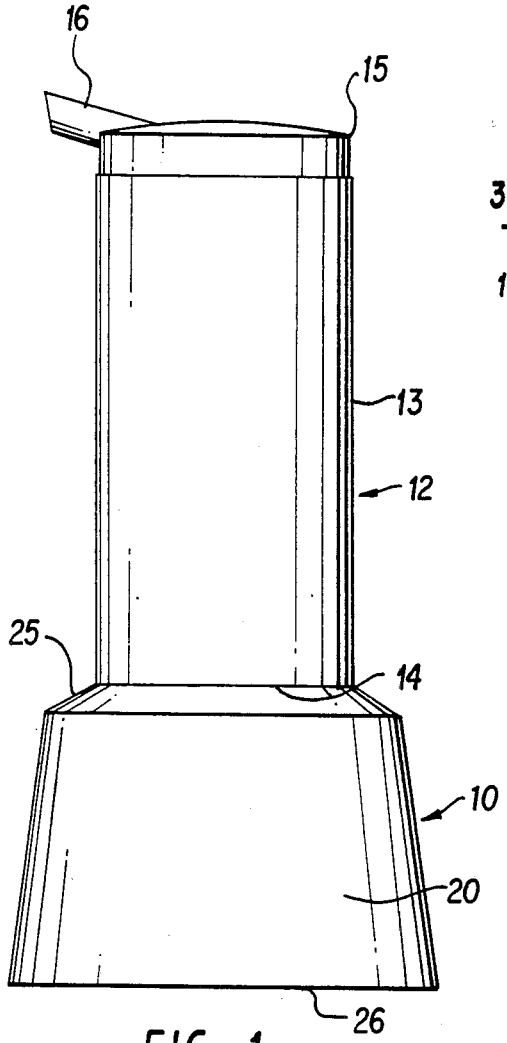
FIG. 1 is an illustrative view of the container or tube of the present invention shown as it is mounted to the dispenser and storage base.
Figure 2:
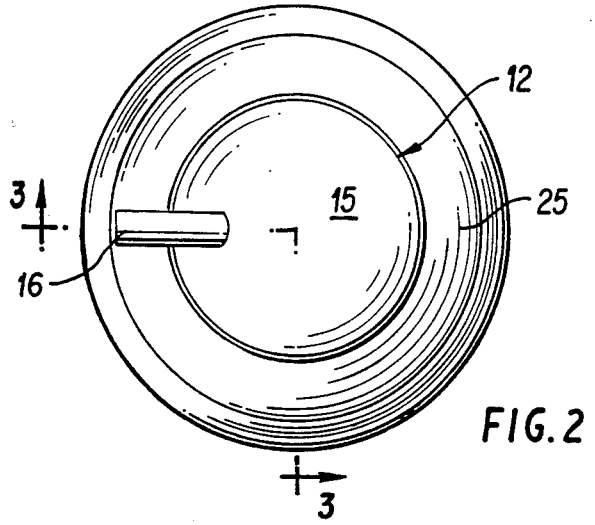
FIG. 2 is a top plan view of the container and dispenser of FIG. 1.

With continued reference to the drawings, the standing dispenser 10 and container 12 of the present invention are shown as they are utilized in assembled working relationship with respect to one another. The dispenser 10 not only functions to urge viscous products such as pastes and creams or the like from within the container 12 but also serves as a stabilizing stand or base for supporting the container and as a storage housing for retaining used portions 12' of the container therein.

The container 12 is generally constructed in a cylindrical shape having a vertical side wall 13 which is substantially uniformly circular in cross-section as taken through a plane normal to the vertical axis A—A of the container. The lower portion of the container is sealed by a lower wall or plug 14 and the upper portion thereof is closed with a cap assembly 15. The cap assembly includes a nozzle 16 through which the contents of the container are discharged.

Although the cap assembly 15 is shown as having an integrally formed spout or nozzle 16, many types of spouts, nozzles and/or valve arrangements could be utlized to guide and regulate the flow of material from the container 12. Additionally, the nozzle may be selectively covered by a separate cap or cover to prevent the containerized product from being exposed to air when the dispenser is not in use. In the embodiment shown, the cap assembly includes a generally circular end portion 17 and a downwardly extending and integrally formed annular rim or flange portion 18. The annular rim or flange is of a diameter to tightly engage the interior of the side wall 13 of the container and is secured thereto in fluid tight relationship. The end portion 17 is formed having a generally concave inner surface.

Figure 3:
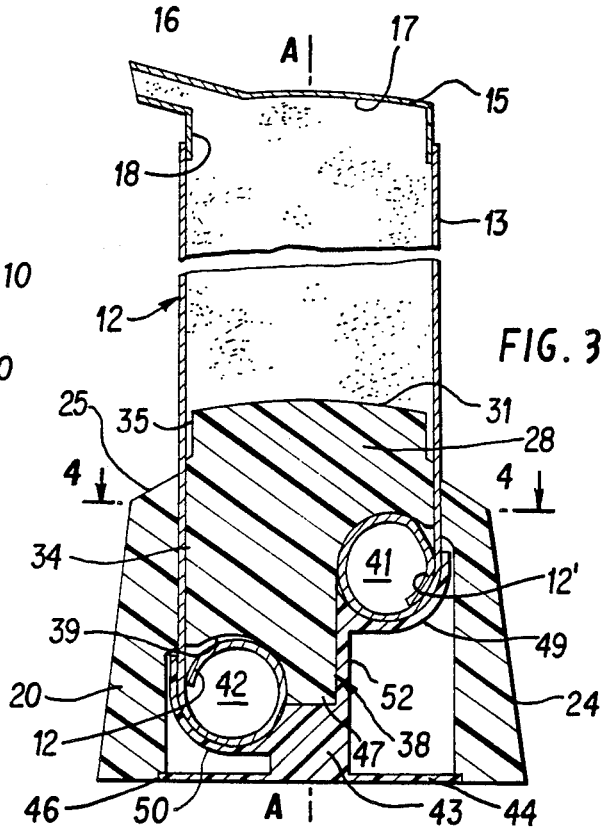
FIG. 3 is a cross-sectional view taken along lines 3-3 of FIG. 2 showing the container being cut and rolled into the storage areas of the dispenser.
Figure 5:
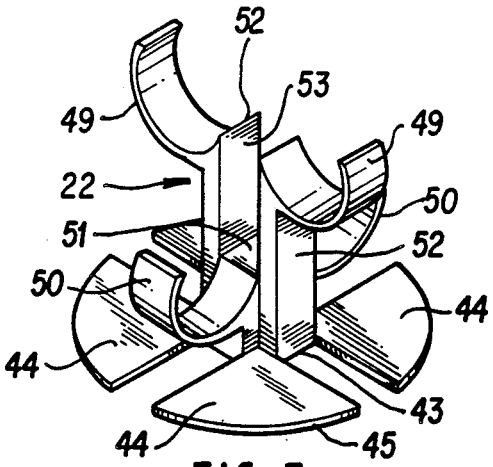
FIG. 5 is a perspective view showing the inner removable containment portion of the dispenser.
Figure 4:
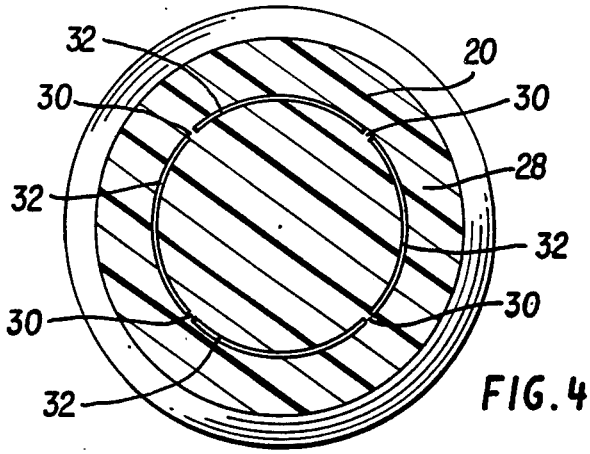
FIG. 4 is a cross-sectional view taken along lines 4-4 of FIG. 3 showing the cutting elements or flanges which connect the fixed piston or body of the dispenser with the base portion thereof.

With particular reference to FIGS. 3-5, the dispenser portion 10 of the invention is shown in greater detail. The dispenser is preferably manufactured in a two part construction having an outer housing 20 and a container containment assembly or inner housing 22. The outer housing is generally integrally molded from a durable and rigid plastic or thermoplastic material having an annular vertically extending side wall or support element 24 which extends downwardly between a sloped or inclined shoulder or rim portion 25 and the base 26 thereof.

The central portion of the dispenser includes a generally cylindrical body or piston member 28 which extends upwardly with respect to the support element 24 and is integrally formed or attached thereto by vertically oriented cutting or slicing flanges or webs 30. As shown in FIG. 4, four such cutting webs 30 are generally used to join the central body portion 28 to the outer annular support element 24. The cutting webs 30 are generally equally radially spaced with respect to one another thereby dividing the area between the central body or piston portion 28 and the outer support element 24 into four generally arcuately shaped open areas or passageways 32.

The uppermost face 31 of the central body or piston member 28 of the dispenser is generally convexly shaped so as to be complementary with the generally concavely shaped lid 17 for reasons which will be discussed in greater detail hereinafter. The upper face 31 defines a fixed or stationary surface which is supported in an elevated relationship to a supporting surface by the annular base portion 24 and severing or cutting webs 30. The diameter of the piston member 28 is substantially equal to the inside diameter of the container or tube 12 so that the outer side walls 34 thereof are in a generally fluid tight and yet sliding engagement therewith. An upper area of the piston 31 is preferably formed having annular side walls 35 which are defined by a diameter slightly less than the diameter of the container 12 to thereby aid in the initial placement of the container into the dispenser assembly 10.

The lower portion of the piston member 28 includes a multi-recessed area 38 which surrounds an axially oriented and integrally formed pedestal 47. The pedestal support 47 of the piston member extends downwardly with respect to the recessed lower area 38 and is formed having two pairs of opposing generally parallel side walls so that the cross-section thereof is rectilinear and preferably square.

The lower area 38 is formed into two pairs of concavely shaped elongated semi-circular grooves 39 and 40. The grooves 39 are shown as being formed generally opposite one another and at a lower portion of the piston than the opposing grooves 40. In this manner, the grooves 39 and 40 form pairs of guide surfaces in the piston member which will cooperate with the inner housing or containment assembly to form inner and outer containment or storage chambers 41 and 42, respectively.

With particular reference to FIG. 5, the container containment assembly or inner housing 22 of the dispenser 10 is shown in greater detail. The containment assembly is preferably integrally constructed of a moldable plastic or thermoplastic material and is of a size to be cooperatively received and secured within the support assembly 24 of the dispenser as shown in cross-section in FIG. 3. The containment assembly includes a central base 43 having a plurality of generally pie-shaped segments or stabilizing wall members 44 extending radially outwardly therefrom. Each stabilizing wall member 44 includes a curved side wall 45 which is frictionally received within an annular mounting groove or key 46 formed in the base support assembly 24. Although the stabilizing members are shown as being separately formed in spaced relationship to one another, the members could be formed as a continuous or single element depending upon the manufacturing or molding techniques used to form the containment assembly.

In order to form the storage areas 41 and 42 in which the used portions 12' of the container 12 may be retained, a pair of upper and lower cradle members 49 and 50, respectively, are integrally formed with and extend outwardly from the base 43 of the containment assembly. Each of the cradle members 49 and 50 are generally U-shaped having upper arcuate surfaces for guiding the severed portions 12' of the container as the container is urged downwardly into the dispenser.

The lower cradle members are formed opposite to one another and a generally planar support surface 51 is created therebetween. When the containment assembly is mounted within the support portion of the dispenser, the pedestal 47 of the piston member will be seated against the support surface 51, as shown in FIG. 3. The upper cradle members 49 are integrally formed and extend outwardly from the upper ends of posts 52. The upper cradle members are, therefore, in vertically spaced relationship with the lower cradle members and are oriented perpendicularly with respect to the lower cradle members. The generally planar or flat inner walls 53 of the posts 52 will cooperatively engage the planar side walls 41 of the pedestal 47 and thereby prevent any relative rotational displacement of the two sections of the dispenser during use.

From the foregoing, the lower cradle members 50 of the containment assembly will cooperate with the lower arcuate grooves 39 of the lower area 38 of the piston member of the dispenser to form the first pair of opposed containment chambers 42. Likewise, the upper cradle members 49 will cooperate with the inner or uppermost arcuate grooves 40 to form the second pair of opposed containment chambers 41.

Although the structure of the invention discussed above discloses cutting flanges or webs 30 which are integrally formed with the piston member and base support portion of the dispenser, it is possible to make the cutters separate elements which elements could be retained in opposing grooves provided in the piston member and base support portion. With this type of structure, metallic cutting elements having more durability could be used in lieu of the integrally formed plastic cutters or webs 30.

In addition to the foregoing, it is possible to use a varied number of cutters 30, openings 32 and containment chambers 41 and 42. Although four cutter elements are preferred for use in cutting the dispenser or tube into four elongated strips, it may be possible to utilize as few as two cutters to simply cut the container into halves which halves would then be rolled and stored within two spaced chambers such as 41 and 42 in the base support element of the dispenser. Alternatively, an increased number of cutters could be used to slice the container into even more than four strips.

It should be remembered that the number of strips into which the container is to be sliced will directly affect the number of blades, cradles and storage areas or chambers which will be necessary. Due to the circular configuration of the container, it is believed that cutting four strips will enable a minimally sized base to be used with the dispenser. It should be remembered that the cradles cooperate with the lower walls of the piston to form generally the cylindrical storage chambers. If fewer slices are made, problems may be encountered in straightening the side walls of the container so as to be easily pushed into a rolled configuration in the storage chambers. By increasing the width of the base portion of the dispenser, potential binding problems between the tube strips and the dispenser can be reduced.

Similarly, if an increased number of cutters are used there will be a increase in the resistance to the container or tube being advanced past or beyond the cutters. The greater the area of contact between the container and cutters, the greater the resistance against the vertical displacement of the container into the dispenser. Also, additional cradle members and piston structuring to provide added storage spaces would require a greater initial construction cost. Therefore, it is believed that the dispenser should be designed to cut a container into an optimum number of four strips.

In the use of the container and dispensing apparatus of the present invention, the container or tube 12 may be supplied separately or together with the dispenser 10. If sold as a unit, the bottom wall 14 of the container may be omitted and the fixed piston member 28 of the dispenser base support permitted to function to seal the bottom of the container. Premature movement of the container with respect to the piston may be prevented by capping the nozzle 16 so that none of the product can be forced from the container and no air permitted therein. Alternatively a sealing tape may be applied between the shoulder 25 of the dispenser base and the lower portion of the side walls 13 of the container. The tape would prevent relative movement between the container and the dispenser support base.

In the event the tube or container includes a bottom wall 14, the tube is initally seated in axial alignment over the face portion 31 of the fixed piston member 28. Thereafter, the tube is pushed downwardly against the piston to free the bottom wall 14 from the container and to substantially simultaneously engage the side walls 13 of the tube or container with the side walls 34 of the piston and to thereby prevent an leakage of material from the tube. In this regard, it may be advantageous to recess the bottom wall 14 inwardly of the container and relative to the lowermost end thereof so that the lowermost ends of the container will engage the side walls 34 of the piston member prior to the bottom wall being engaged by the face thereof. Subsequent dislodgement of the bottom wall may only occur, therefore, after the piston and container are in sealed but sliding engagement with one another.

In order to dispense product from the container the user need merely push downwardly on the lid 15 of the upright container. As the pressure on the lid forces the container against the face of the piston member, the product will be forced upwardly and outwardly through the nozzle 16. Once the application of pressure to the cap is stopped, no further product will flow from the nozzle. During the continued use of the container and dispensing assembly, the container walls will be forced against the upper cutting edges of the flanges 30 which connect the piston member 28 with the dispenser housing or base 24. As the container is severed into a plurality of strips 12', each strip will be subsequently curled and rolled into a generally cylindrical shape by the cooperation of the cradle members 49 and 50 and the shaped lower walls 39 and 40 of the piston.

As the container is pushed beyond the piston face, the piston structure will insure that substantially all the product is urged outwardly of the container nozzle as the side walls thereof are in intimate contact with the inner walls of the container. In addition, as the shape of the piston face 31 is complementary to that of the interior 17 of the lid 15, substantially all of the product within the container will be urged outwardly from the cap during use.

Once the cap contacts the top or face of the piston, the containment portion 22 of the dispenser is snapped from engagement with the dispenser housing or base 20 and the cut or old container removed from the dispensing base and disposed of. Alternatively, if the entire assembly is disposable, the entire assembly may be discarded when the container lid is seated against the face of the piston.

I claim:

1. An apparatus for dispensing paste products comprising a container having cylindrical side walls and upper and lower portions, said cylindrical side walls being defined by a first diameter, nozzle means carried by said upper portion of said container, a dispenser means having a generally central piston means and a base portion, said piston means having side walls which are retained in spaced relationship from said base portion so as to create a generally annular passageway therebetween, at least two spaced cutter means disposed across said passageway and between said piston means and said base portion, said container being mounted over said piston means so that said cylindrical side walls of said container are slidably received in said passageway, so that as said container is urged toward said piston means the paste product will be dispensed from said nozzle means and said cylindrical side walls of said container will pass along said passageway and be severed into strips by said cutter means, a supplemental containment assembly carried within said base portion of said dispenser means, said supplemental containment assembly including at least two generally U-shaped cradle members which are open toward said lower end of said piston means, said piston means being generally cylindrical and having a central axis which extends between upper and lower ends, said upper end of said piston means being in vertically spaced relationship above said cutter means, said lower end of said piston means having at least two spaced generally semi-circular grooves therein for guiding said strips of said container, and semi-circular grooves extending generally perpendicular with respect to said axis of said piston means, one of each said cradle members being oriented in opposing relationship with one of said grooves in said piston means and being aligned so as to guide said strips of said container as said strips pass through said passageway whereby said grooves and said cradle means retain said strips therebetween.

2. The dispensing apparatus of claim 1 in which said piston means, said base portion and said cutter means of said dispenser means are integrally formed.

3. The dispensing apparatus of claim 2 in which said supplemental containment assembly is removably mounted to said base portion of said dispenser means.

4. The dispensing apparatus of claim 1 in which said at least two grooves in said lower end of said piston means are generally parallel with respect to one another.

5. The dispensing apparatus of claim 4 including at least two additional generally semi-circular grooves formed in said lower end of said piston means, said additional grooves being in generally parallel relationship with one another and being oriented more deeply into said piston means than said at least two grooves, and said supplemental containment assembly including at least a first and second pair of generally U-shaped cradle means, said first pair of said cradle means being oriented in vertically spaced elevated relationship with respect to said second pair of said cradle means so that said first pair of said cradle means are in opposing spaced relationship with said additional grooves in said piston means, and said second pair of said cradle means being in spaced opposing relationship with said at least two grooves in said piston means.

6. The dispensing apparatus of claim 5 including at least four cutter means separating said passageway into at least four generally equally spaced passages.

7. The dispensing apparatus of claim 6 in which said supplemental containment assembly includes a central base member having a pair of post means extending upwardly therefrom, said post means being in spaced parallel relationship with respect to one another and having upper ends, said first pair of cradle means being integrally formed with said upper ends of said post means and extend outwardly with respect thereto, and said second pair of cradle means being integrally formed with and extending outwardly from said central base member so as to be disposed at generally right angles to said first pair of cradle means.

8. The dispensing apparatus of claim 7 in which said piston means includes an axially extending pedestal portion extending downwardly from said lower end thereof, said pedestal portion of said piston means engaging said central base member of said supplemental containment assembly.

9. The dispensing apparatus of claim 8 in which said pedestal portion of said piston means includes two pairs of generally parallel opposing side walls, one pair of said side walls being mounted in substantially parallel abutting engagement with said pair of post means.

10. A dispenser for dispensing cream or paste-like products from a container having generally cylindrical side walls, a nozzle adjacent one end thereof and a generally circular mounting end portion comprising a base portion and a piston means which extends upwardly and generally centrally of said base portion, a substantially annular opening between said piston means and said base portion, said opening being of a size to permit the side walls of the container to be slidably received therethrough, at least two cutter means disposed across said annular opening between said piston means and said base portion so that as the container is placed with the mounting end portion thereof about said piston means continued vertical downward pressure on the container will cause the container to move downwardly through said annular opening wherein the walls of the container will be sliced by said cutter means into strips, said cutter means including a fixed cutting edge oriented generally perpendicularly with respect to said annular opening so as to extend upwardly with respect to said base portion, at least a portion of said piston means being of substantially equal diameter with respect to the cylindrical container, said piston means having a lower portion, at least two arcuately shaped grooves formed in said lower portion of said piston means, a supplemental containment means disposed within said base portion, said containment means having at least two generally U-shaped cradle means which are disposed below said opening to receive the strips passing through said opening, each of said cradle means being disposed in generally opposing spaced relationship with one of said grooves so that the surfaces thereof form generally circular guide paths for guiding the strips within the base portion.

11. The dispenser of claim 10 including first and second pairs of cradle means carried by a central base, post means for mounting said first pair of cradle means in elevated relationship and at approximately right angles to said second pair of cradle means, first and second pairs of arcuately shaped grooves formed in said lower portion of said piston means, said first pair of grooves being more deeply recessed into said piston means than are said second pair of grooves, said first pair of cradle means being disposed in opposing and generally parallel relationship to said first grooves and said second cradle means being disposed in opposing and generally parallel relationship to said second grooves and at least four cutter means disposed across said opening thereby dividing said opening into four generally equal open segments.

12. The dispenser of claim 11 in which said piston means includes an axially extending pedestal portion extending downwardly from said lower end thereof, support means carried by said central base, said pedestal portion of said piston means engaging said support means, and wall means carried by said central base for engaging said pedestal portion to prevent the relative rotation of said piston means with respect to said central base.

13. A dispensing apparatus for urging viscous products from generally cylindrical collapsible wall containers and for simultaneously supporting the container in an upright container and for progressively storing severed positions of the housing as the container is moved toward the dispensing apparatus comprising a generally central piston means and a base position, said piston means having upper and lower ends and having side walls which are retained in spaced relationship from said base portion so as to create a generally arcuate passageway therebetween in which the cylindrical containers are relatively and slidably received, said base portion having side walls extending outwardly and downwardly with respect to said lower end of said piston means, at least two equally spaced cutter means disposed across said passageway and between said piston means and said base portion, a supplemental containment assembly disposed within said base position said supplemental containment assembly including at least two generally U-shaped cradle members which are open toward said lower end of said piston and in alignment with said passageway, said cradle members being spaced from said lower end of said piston means so as to guide the severed portions of the container therebetween as the container is urged downwardly relative to said piston means through said passageway.

14. The dispensing apparatus of claim 13 in which said lower end of said piston means includes at least two spaced generally semi-circular grooves therein for cooperating with said U-shaped cradle members to guide said severed portions of the container therebetween.

15. The dispensing apparatus of claim 14 including at least four cutter means generally equally spaced across said passageway and between said piston means and said base portion, said containment assembly including at least four generally U-shaped cradle members and at least four generally semi-circular grooves in said lower end of said piston means.

16. The dispensing apparatus of claim 15 in which at least two of said cradle members extend upwardly with respect to the other of said cradle members, and at least two of said grooves is said piston are oriented above the other of said grooves.

* * * * *